United States Patent [19]

Williams

[11] 4,127,266

[45] Nov. 28, 1978

[54] PROXIMITY CALIPER

[75] Inventor: Charles H. Williams, Chicago, Ill.

[73] Assignee: R. R. Donnelley & Sons Company, Chicago, Ill.

[21] Appl. No.: 773,507

[22] Filed: Mar. 2, 1977

[51] Int. Cl.[2] ..... B65H 7/12

[52] U.S. Cl. ..... 271/263; 192/127; 270/56; 340/675; 271/277

[58] Field of Search ..... 271/263, 262, 256, 277; 340/259; 270/56; 192/127

[56] References Cited

U.S. PATENT DOCUMENTS

| | | | |
|---|---|---|---|
| 2,145,520 | 1/1939 | McFarlane | 270/56 |
| 2,702,189 | 2/1955 | Zugel et al. | 271/263 X |
| 2,711,896 | 6/1955 | Kleineberg et al. | 271/262 X |
| 3,713,646 | 1/1973 | Derc | 271/263 |

*Primary Examiner*—Bruce H. Stoner, Jr.
*Attorney, Agent, or Firm*—Wegner, Stellman, McCord, Wiles & Wood

[57] ABSTRACT

A proximity caliper for sensing the correct thickness of printed signatures is mounted on an apparatus for feeding printed sheets. A metal gripper which retains a signature against a rotatable drum traverses the caliper as the drum transfers the signature from one point to another. The proximity of the metal gripper with respect to the caliper is a function of signature thickness. Hence, the signature having too many or too few pages is detected. The proximity caliper includes at least two proximity sensors which do not come in contact with the metal gripper. The position of the sensors is adjustable with respect to the rotatable drum to accommodate signatures having a wide range of different thicknesses. The sensors are also adjustable with respect to each other to control the sensing tolerance. Signatures of the correct thickness are transferred by the drum and normal operation of the feeding apparatus proceeds. Signatures which are detected as having an incorrect number of pages may be removed.

4 Claims, 5 Drawing Figures

PROXIMITY CALIPER

BACKGROUND OF THE INVENTION

This invention relates to apparatus for the feeding of printed sheets and, more particularly, to a proximity caliper for detecting the thickness of printed signatures.

Devices for feeding printed signatures having two or more pages are employed for accumulating several different signatures to form a book or magazine. An example of such a device is shown in U.S. Pat. No. 3,880,419. This structure is capable of feeding printed signatures of different dimensions and thicknesses.

The apparatus shown in the above-cited patent is not equipped with means for sensing the correct thickness of the individual signatures which are fed from a stack supply to a conveyor by way of a rotatable drum. The thickness of the signature is proportional to the number of pages in it and thus, if a page is missing or if an extra page is included, this undesirable condition is not detected.

I have invented a device capable of being mounted on an apparatus for feeding printed sheets including the apparatus of the type shown in the above-cited patent which, after being appropriately adjusted, senses the thickness of the printed signature being fed.

SUMMARY OF THE INVENTION

Two proximity sensors form a caliper which is coupled to the frame of a device for feeding printed sheets. The position of a metal gripper which holds the signature against a rotatable drum is detected by the sensors. Sensing the appropriate thickness occurs as the gripper traverses the faces of the sensors. The sensors are mounted on a movable plate, the position of which is adjusted with respect to the rotatable drum to accommodate signatures having a wide range of different thicknesses. Sensing tolerance may be controlled by the adjustment of the position of one sensor with respect to the other.

It is a feature of the present invention to provide a device for sensing the thickness of printed signatures which does not require the use of mechanical contacts.

Another feature of the present invention is to provide a non-contact caliper for sensing the thickness of printed signatures which mounts directly upon the frame of a feeding apparatus.

Another feature of the present invention is to provide a non-contact caliper which may be adjusted to accommodate signatures having a wide range of different thicknesses.

Another feature of the present invention is to provide a caliper wherein the sensing tolerance is established by the adjustment of one sensor with respect to the other.

Other features of the present invention will become apparent when considering the specification in combination with the drawing in which:

DESCRIPTION OF THE PREFERRED EMBODIMENT

Figure 1:
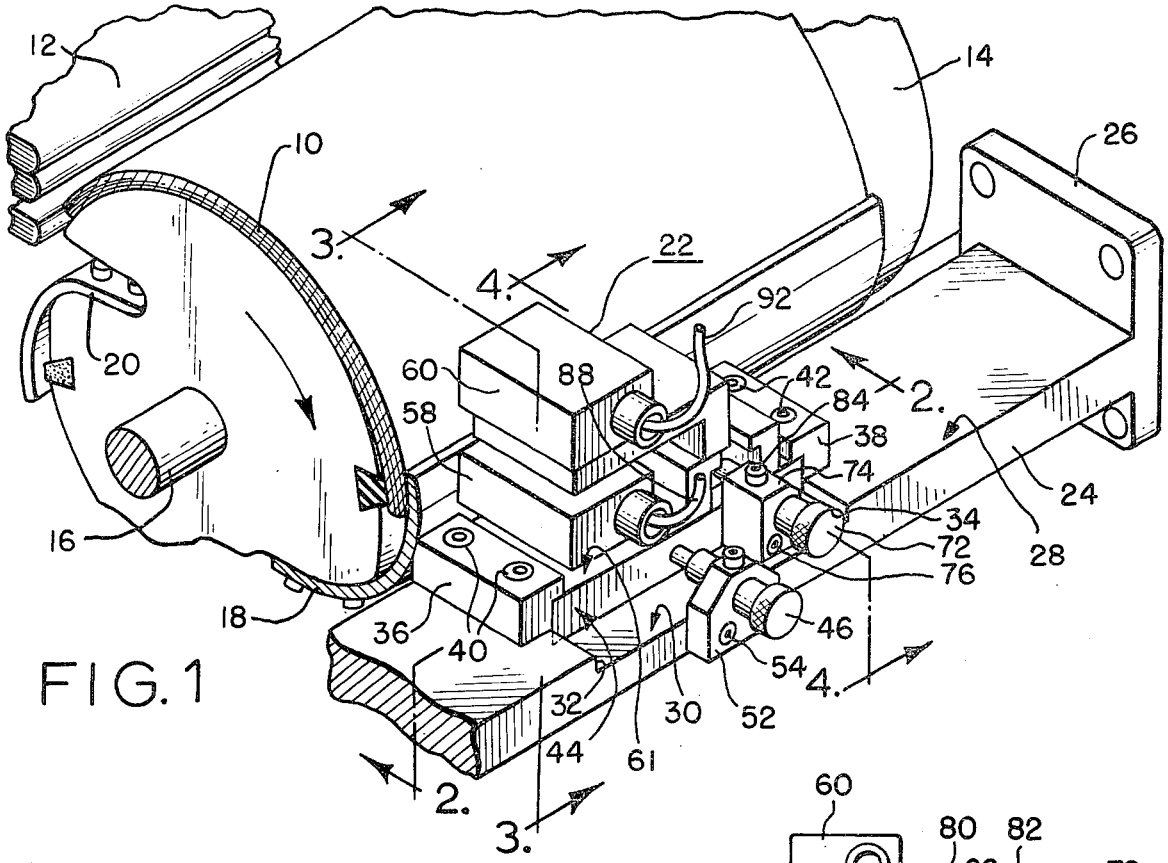
FIG. 1 is a perspective view of the caliper.
Figure 2:
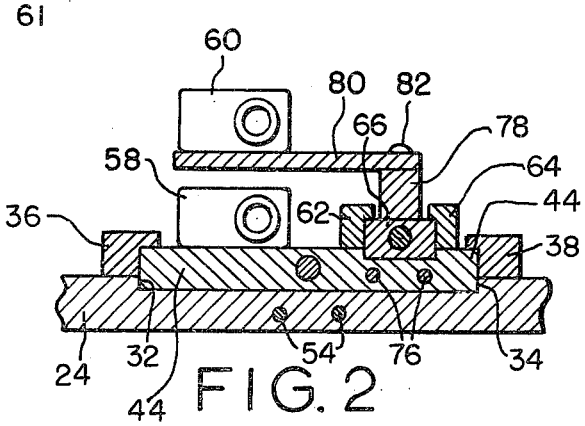
FIG. 2 is a cross-sectional view of the caliper.
Figure 3:
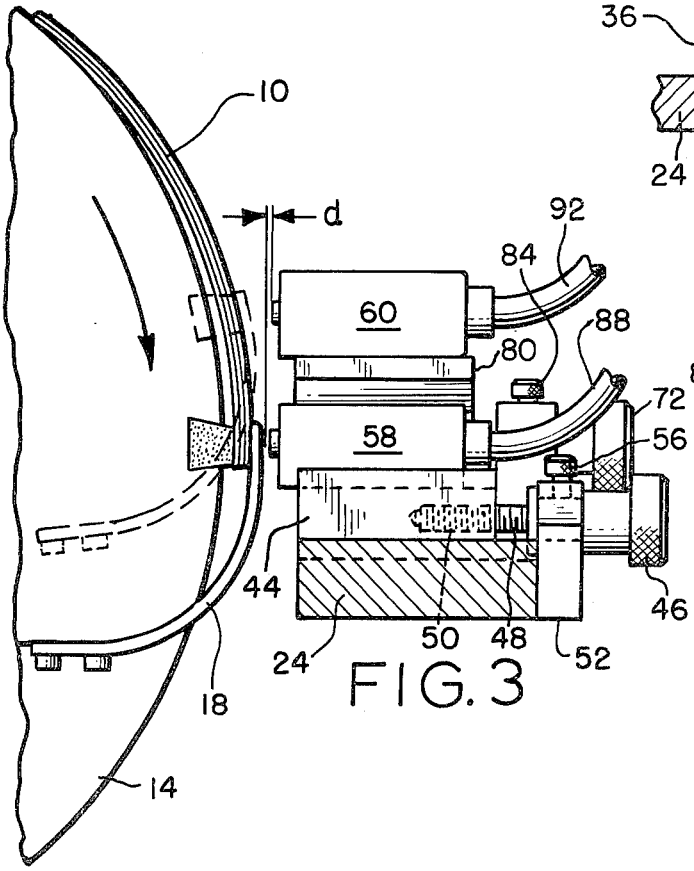
FIG. 3 is another cross-sectional view of the caliper.
Figure 4:
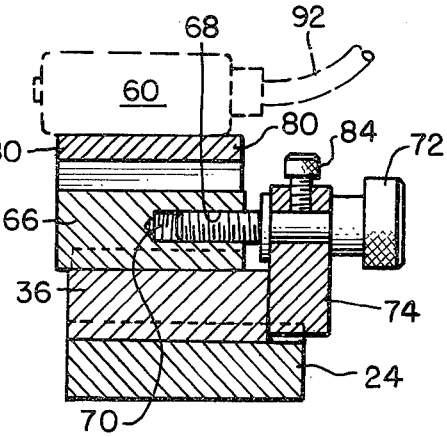
FIG. 4 is yet another cross-sectional view of the caliper.

Referring to FIG. 1, printed signature 10 is to be transferred from a stack supply 12 to a conveyor (not shown) by rotatable drum 14. Drum 14 rotates about shaft 16 and carries a pair of metal grippers 18 and 20. Gripper 18 transfers the printed signature 10 as drum 14 rotates in the direction shown. As gripper 18 traverses the caliper 22, the thickness of the printed signature 10 is sensed. As the drum 14 rotates further, the signature 10 is delivered to the conveyor. Gripper 20 receives another printed signature from the stack supply 12 as drum 14 rotates, and the thickness of that printed signature is sensed as gripper 20 traverses the caliper 22. The printed signature is then delivered to the conveyor. Feeding of printed signatures from the stack supply 12 to the conveyor continues as drum 14 rotates. A printed signature of incorrect thickness, as detected by caliper 22, either provides an indication to the operator or stops the rotation of the drum 14.

Referring to FIGS. 1–4, bar 24 spans cylindrical drum 14 and provides support for the caliper 22. Bar 24 is rigidly attached to the frame of the device for feeding printed sheets at its ends by plates, such as plate 26. Surface 28 of bar 24 has a channel 30 bounded by sides 32 and 34. Mounted along sides 32 and 34 are guides 36 and 38, respectively. The guides are secured to bar 24 by screws 40 and 42. Channel 30 receives movable plate 44 and lateral movement of the plate 44 is restrained by sides 32 and 34 and by guides 36 and 38. Caliper 22 is mounted on plate 44 and may be positioned with respect to drum 14 by the adjustment of knob 46. Knob 46 is coupled to threaded bolt 48 which is received by threaded bore 50 in plate 44. Bolt 48 projects through bracket 52, which is rigidly attached to bar 24 by screws 54. Retaining screw 56 is tightened to maintain the position of bolt 48 within bracket 52, thereby assuring that the appropriate position of caliper 22 is maintained.

The caliper 22 consists of two proximity sensors 58 and 60. The sensors provide a voltage output which is proportional to the proximity of metal grippers 18 and 20 as they traverse the faces of the sensors 58 and 60. As will be explained in greater detail below, sensor 58 detects the condition of a printed signature 10 being too thin and sensor 60 detects the condition of the printed signature 10 being too thick.

Sensor 58 is rigidly attached to upper surface 61 of plate 44. Also attached to upper surface 61 are guides 62 and 64 which form a channel that receives slidable plate 66. Slidable plate 66 has a threaded bore 68 at its end to receive adjustment bolt 70. Adjustment bolt 70, having knob 72, projects through bracket 74. Bracket 74 is rigidly attached to the side of plate 44 by screws 76. The position of knob 72 controls the position of plate 66 with respect to plate 44. Spacer 78 is rigidly attached to plate 66. Spacer 78 provides support for plate 80 which is attached thereto by screws 82. Sensor 60 is rigidly attached to plate 80 and when the desired position of sensor 60 is established, retaining screw 84 is tightened to secure bolt 70 within bracket 74.

Adjustment of the position of the sensors 58 and 60 with respect to each other and with respect to drum 14 will now be described. Sensor 58 is adjusted to detect the condition where signature 10 is too thin. Sensor 60 is adjusted to detect the condition where the signature 10 is too thick. The relative spacing $d$ between the faces of sensor 58 and sensor 60 determines the sensitivity of the caliper 22. The smaller the distance *d*, the more sensitive the caliper 22 is to acceptable signature thickness. A signature of minimum acceptable thickness is placed on drum 14 in metal gripper 18 in front of sensor 58. Knob 46 is adjusted so that sensor 58 moves toward the metal gripper. As the sensor moves closer to drum 14, the presence of metal gripper 18 is detected. When detector occurs, retaining screw 56 is tightened and sensor 48 is correctly positioned. The signature of minimum acceptable thickness is now placed under metal gripper 20. Drum 14 is then rotated to position metal gripper 20 in front of sensor 58. Metal gripper 20 is detected by sensor 58 in the same manner as metal gripper 18 was detected. The signature of minimum acceptable thickness is removed and replaced by a signature of maximum acceptable thickness. Drum 14 is rotated so that the metal gripper 20 is in front of sensor 60. Adjustment knob 72 is turned to move sensor 60 toward drum 14 so that it detects the presence of metal gripper 20. When detection occurs, knob 72 is backed off to withdraw sensor 60 to position it at the threshold of detecting the metal gripper 20. Retaining screw 84 is then tightened and sensor 60 is correctly positioned. The relative distance *d* is therefore fixed and the caliper 22 is adjustable with respect to the drum 14 by knob 40 to accommodate printed signatures of a wide range of different thicknesses.

A third sensor or switch (not shown) is mounted at any suitable location along the drum 14 or shaft 16 to provide a timing signal for gating the information from the sensors. For example, a cam having opposing lobes may be mounted on the shaft of the drum so that a gating pulse is provided each time the metal grippers 18 and 20 traverse caliper 22.

Figure 5:
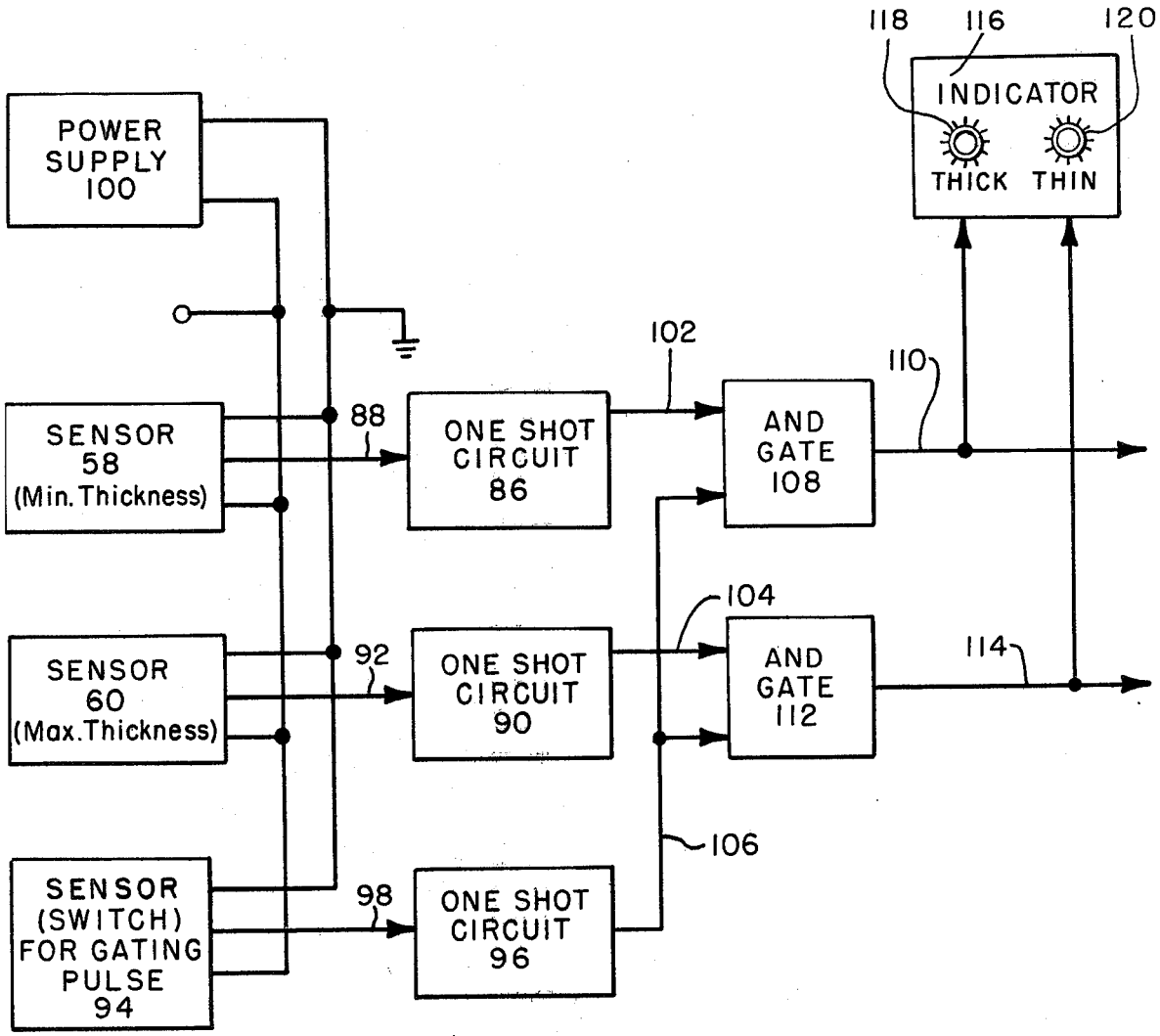
FIG. 5 is a block diagram of the circuit which processes the information sensed by the caliper.

Referring to FIG. 5, a typical circuit schematic of the proximity caliper 22 is shown. Sensor 58, which detects minimum thickness, is coupled to one-shot circuit 86 by line 88. Sensor 60, which detects maximum thickness, is coupled to one-shot circuit 90 by line 92. A third sensor 94 provides the gating pulse and is coupled to one-shot circuit 96 by line 98. Each of the sensors is provided with the appropriate electrical potential from power supply 100 in the well known manner. The one-shot circuits 86, 90 and 96 provide an output pulse if the input, on lines 86, 92 and 98, respectively, exceeds a predetermined threshold level as established by the one-shot circuits. Sensor 58, providing information to one-shot circuit 86, causes one-shot circuit 80 to produce a pulse on output 102 each time metal gripper 18 or 20 is detected if the sensor 48 is adjusted in the manner discussed above. A signature of a thickness less than minimum thickness will not produce an output pulse from one-shot circuit 86. Similarly, sensor 60, providing information to one-shot circuit 90, causes one-shot circuit 90 to provide a pulse on output 104 if the signature is thicker than the maximum thickness.

The sensor or switch 94 for providing a gate pulse triggers one-shot circuit 96 each time the metal grippers 18 and 20 traverse the sensors 58 and 60 to provide an output pulse on line 106. The outputs of the one-shot circuits 86 and 96 are provided to AND gate 108. An output pulse from AND gate 108 on line 110 occurs when a printed signature having a thickness greater than minimum thickness is detected by sensor 58 during the presence of the gate pulse from one-shot circuit 96.

The outputs of one-shot circuits 90 and 96 are applied to AND gate 112. An output pulse from AND gate 112 on line 114 occurs only when a signature having a thickness greater than maximum thickness is detected by sensor 60 during the presence of the gate pulse from one-shot circuit 96.

The outputs 110 and 114 of the AND gates 108 and 112 are coupled to the indicator 116. If indicator 116 receives a pulse only from AND gate 108, an indication of proper thickness is provided. If indicator 116 receives a pulse from AND gate 108 and from AND gate 112, an indication of a printed signature exceeding the maximum thickness is provided. If the indicator 116 receives no pulse from either output of AND gate 108 or AND gate 112, an indication of a printed signature having thickness less than the minimum thickness is provided. Lamps 118 and 120 provide a indication of a too thick or too thin condition, respectively. Also, lines 110 and 114 may be coupled to a controller to stop the rotation of drum 14 if a signature of incorrect thickness is detected.

I claim:

1. In an apparatus for feeding printed sheets having a frame, a rotatable drum carrying a metal gripper a bar attached to said frame adjacent and spanning said rotatable drum, the gripper adapted to receive a printed signature between said gripper and said rotatable drum, the improvement comprising:

a first movable plate slidably mounted on the bar for movement toward and away from the drum;

a first proximity sensor mounted on the movable plate;

a second plate slidably received by the first movable plate for movement toward and away from the drum; and a second proximity sensor mounted on said second plate, said sensors providing electrical signals indicative of the position of the metal gripper with respect to the first and second proximity sensors as the gripper traverses said first and second proximity sensors, wherein the position of the metal gripper with respect to said first and second proximity sensors is determined by the thickness of the printed signature.

2. The apparatus of claim 1 further including:

a first adjustment means coupled to the bar and to the first movable plate to control and secure the position of the movable plate with respect to the metal gripper; and a second adjustment means coupled to the first movable plate and the second plate to control and secure the position of the second sensor with respect to the first sensor.

3. The apparatus of claim 1 further including:

means for providing a gating pulse each time the metal gripper traverses the first and second sensors; and circuit means connected to the first and second sensors and said means for providing a gating pulse, said circuit means including an indicator for providing an indication of a printed signature having an incorrect thickness as the metal gripper traverses the first and second sensors.

4. A caliper for sensing the correct thickness of printed signatures as the signatures are transferred from one point to another by a rotating drum, metal grippers retaining said printed signatures against the drum comprising:

a bar mounted on the feeding apparatus and spanning the drum;

a first movable plate slidably mounted on the bar for movement toward and away from the drum;

a first sensor rigidly attached to the first movable plate;

a first adjustment means coupled to the bar and the first movable plate to control and secure the position of the movable plate with respect to the metal grippers;

a second plate slidably received by the first movable plate for movement toward and away from the drum;

a second sensor rigidly attached to the second plate;

a second adjustment means coupled to the first movable plate and the second plate to control and secure the position of the second sensor with respect to the first sensor;

means for providing a gating pulse each time the metal gripper traverses the first and the second sensors; and circuit means connected to the first and second sensors and said means for providing a gating pulse, said circuit means coupled to an indicator for providing an indication of a printed signature having an incorrect thickness as the metal gripper traverses the first and the second sensors.

* * * * *